US007793904B2

(12) United States Patent
Scarton et al.

(10) Patent No.: US 7,793,904 B2
(45) Date of Patent: Sep. 14, 2010

(54) BEVERAGE HOLDER ASSEMBLY

(76) Inventors: Michael G. Scarton, 219 Windermere Ct., McMurray, PA (US) 15317; Eric M. Prado, 220 Windermere Ct., McMurray, PA (US) 15317; Erik R. Mertens, 202 Windermere Ct., McMurray, PA (US) 15317

( * ) Notice: Subject to any disclaimer, the term of this patent is extended or adjusted under 35 U.S.C. 154(b) by 0 days.

(21) Appl. No.: 11/842,926

(22) Filed: Aug. 21, 2007

(65) Prior Publication Data

US 2009/0050766 A1 Feb. 26, 2009

(51) Int. Cl.
*A47G 29/00* (2006.01)

(52) U.S. Cl. ..... 248/311.2; 248/230.5; 224/414

(58) Field of Classification Search ..... 248/311.2, 248/310, 314, 229.1, 229.14, 229.24, 228.5, 248/230.5, 231.61, 224.51, 224.61, 223.41; 224/414, 420

See application file for complete search history.

(56) References Cited

U.S. PATENT DOCUMENTS 2,731,182 A * 1/1956 Higgins ..... 224/566
2,996,938 A * 8/1961 Holtzclaw et al. ..... 81/3.09
3,061,254 A * 10/1962 Piasecki ..... 248/74.4
3,881,677 A * 5/1975 Ihlenfeld ..... 248/311.2
4,595,165 A * 6/1986 Klingensmith et al. ..... 248/539
4,830,240 A * 5/1989 Tackles et al. ..... 224/414
5,320,444 A * 6/1994 Bookwalter et al. ..... 403/323
5,356,107 A * 10/1994 Sinohuiz ..... 248/311.2
6,505,802 B2 * 1/2003 Fowler ..... 248/311.2
6,942,131 B2 * 9/2005 Trautman et al. ..... 224/414
7,156,353 B2 * 1/2007 Kringel et al. ..... 248/311.2
2005/0061935 A1 * 3/2005 Leedholm ..... 248/231.71

* cited by examiner

*Primary Examiner*—Anita M King

(57) ABSTRACT

Various embodiments are directed to a beverage holder assembly. In some embodiments, a beverage holder assembly may comprise a clamp device comprising a screw for tightening a first arm and a second arm to attach the clamp device to a structure. The screw may comprise a head having parallel sides. The beverage holder assembly may comprise a beverage housing to support a beverage container. The beverage housing may define a track to receive the head of the screw. Other embodiments are described and claimed.

9 Claims, 4 Drawing Sheets

BEVERAGE HOLDER ASSEMBLY

BACKGROUND

In many situations, it is inconvenient to hold a beverage by hand. Accordingly, a need exists for an improved beverage holder assembly.

SUMMARY

Various embodiments are directed to a beverage holder assembly. In some embodiments, a beverage holder assembly may comprise a clamp device comprising a screw for tightening a first arm and a second arm to attach the clamp device to a structure. The screw may comprise a head having parallel sides. The beverage holder assembly may comprise a beverage housing to support a beverage container. The beverage housing may define a track to receive the head of the screw. Other embodiments are described and claimed.

DETAILED DESCRIPTION

Various embodiments are directed to a beverage holder assembly and/or components thereof. It is to be understood that the figures and descriptions of various embodiments have been simplified to illustrate elements that are relevant for a clear understanding of the present invention, while eliminating, for purposes of clarity, other elements. Those of ordinary skill in the art will recognize, however, that these and other elements may be desirable. However, because such elements are well known in the art, and because they do not facilitate a better understanding of the present invention, a discussion of such elements is not provided herein.

Referring now to the several drawings in which like elements are numbered identically throughout, a description of this invention now will be provided, in which exemplary embodiments are shown in the several figures. This invention may be embodied in many different forms and should not be construed as being limited to the embodiments set forth herein. Rather, these embodiments are provided so that this disclosure will be thorough and complete, and will fully convey the scope of the invention to those having ordinary skill in the art. Furthermore, all statements herein reciting embodiments of the invention, as well as specific examples, are intended to encompass both structural and functional equivalents thereof. Moreover, it is intended that such equivalents include both currently known equivalents as well as equivalents developed in the future for performing the same function, regardless of structure. Thus, those skilled in the art will appreciate that the schematic drawings presented herein and the like, represent conceptual views of illustrative structures which may embody the various aspects of this invention.

Figure 1:
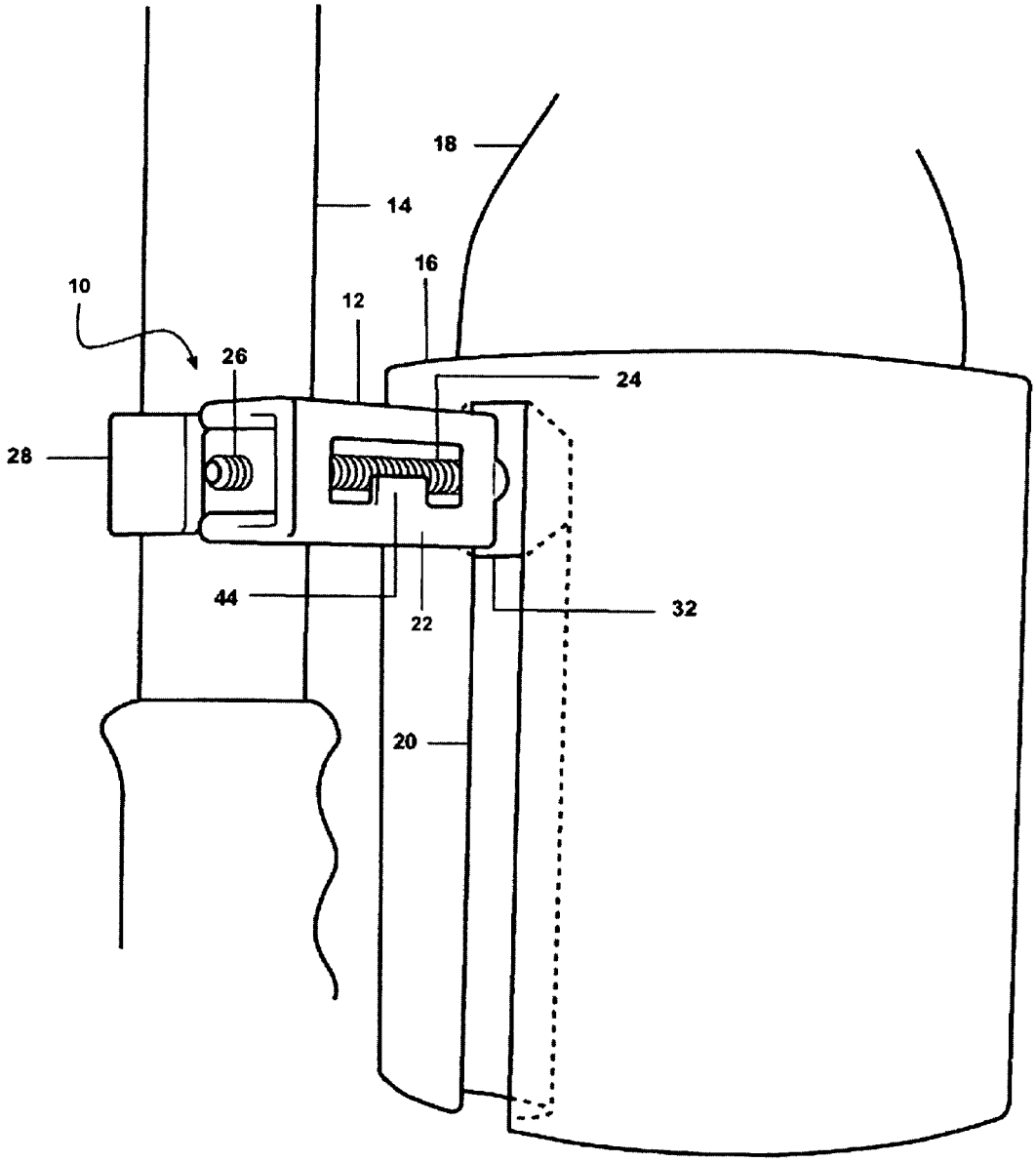
FIG. 1 illustrates one embodiment of a beverage holder assembly.

FIG. 1 illustrates one embodiment of a beverage holder assembly 10. In various implementations, beverage holder assembly 10 is designed to be securely mounted to a structure 14 such as an umbrella, baby stroller, golf cart, bicycle handlebar, beach chair, boat bimini, tree stand, and other similar structures. As shown in this exemplary embodiment, beverage holder assembly 10 comprises a clamp device 12 configured to attach to an umbrella shaft. Clamp device 12 also is configured to engage and attach to a separable beverage housing 16.

Beverage housing 16 may be structured to support a beverage container 18 such as a bottle, can, cup, and so forth. Beverage housing 16 may be flexible, foldable, collapsible, or rigid. In some embodiments, beverage housing 16 may be insulated. As shown, beverage housing 16 may be cup-shaped having a bottom and sides. It is to be appreciated that the sides of beverage housing may be closed or open (e.g., slotted, woven, meshed, interlaced, etc.). In some cases, beverage housing 16 may be bottomless.

In various embodiments, beverage housing 16 includes a track 20. In some implementations, track 20 may be defined by or cut into a wall of beverage housing 16. In other implementations, track 20 may be defined in a plastic panel to be inserted into, attached to, or integrated with beverage housing 16 or beverage container 18.

Clamp device 12 includes a body portion 22 and a screw 24 passing through a first hole (not shown) and a second hole 26 defined in body portion 22. Second hole 26 may be threaded to accept screw 24. First hole is used as a guiding hole and typically is not threaded, but could be in some embodiments.

Figure 2:
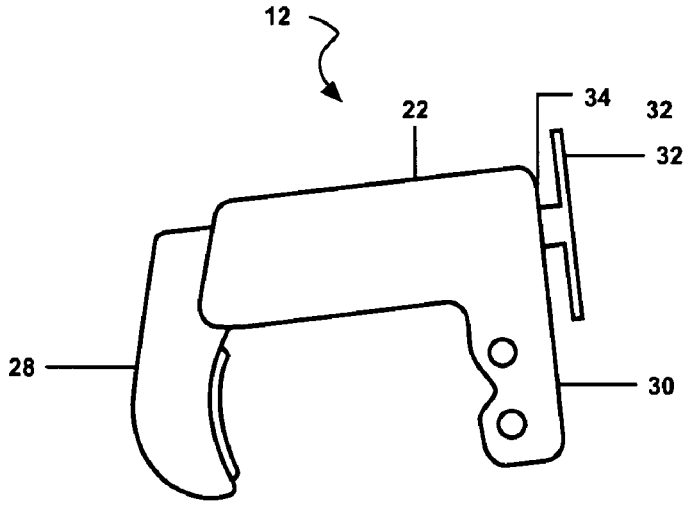
FIGS. 2-4 illustrate one embodiment of a clamp device for use in a beverage holder assembly.
Figure 3:
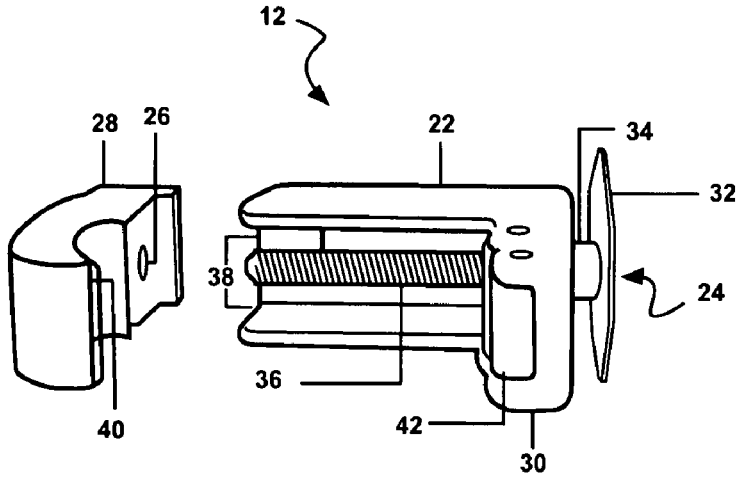
Figure 4:
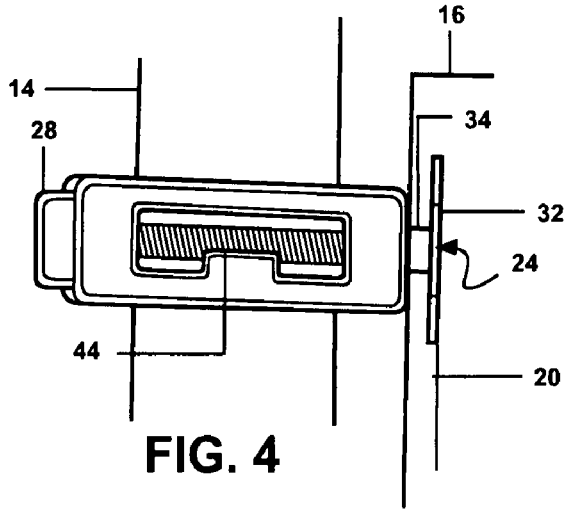

As shown in FIGS. 2-4, clamp device 12 may comprise substantially U-shaped body portion 22 including an adjustable arm 28 and a fixed arm 30. Adjustable arm 28 may define threaded hole 26 to accept screw 24. Screw 24 includes a head 32, a neck 34, and a threaded portion 36. In various embodiments, neck 34 may have a larger diameter or is otherwise thicker than a hole (e.g., first hole) defined in fixed arm 30 of body portion 22 to limit the passage of screw 24 through body portion 22.

When threaded portion 36 is received by threaded hole 26, the turning of head 32 of screw 24 in a clock-wise direction results in threaded portion 36 passing through hole 26 and adjustable arm 28 moving toward fixed arm 30 to tighten and secure clamp device 12 to structure 14. In some embodiments, body portion 22 may comprise grooves 38 for receiving and allowing adjustable arm 28 to slide within body portion 22. In some implementations, adjustable arm 28 may comprise a pad 40 and/or fixed arm 30 may include one or more circular rollers 42 to facilitate securing of clamp device 12 to structure 14.

In various embodiments, body portion 22 may comprise a bottle opener 44. As shown, body portion 22 may include a substantially U-shaped slot or cut-out and a protrusion structured and arranged to be used as bottle opener 44.

As shown, head 32 of screw 24 may have an octagonal shape with parallel sides designed slide within track 20. Neck 34 may limit the passage of screw 24 through body portion 22 and provide sufficient separation or clearance to allow head 32 of screw 24 to slide within track 20. As shown in FIG. 4, neck 34 of screw 24 may have a length such that beverage housing 16 and body portion 22 abut when head 32 of screw 24 is slid within track 20.

Figure 5:
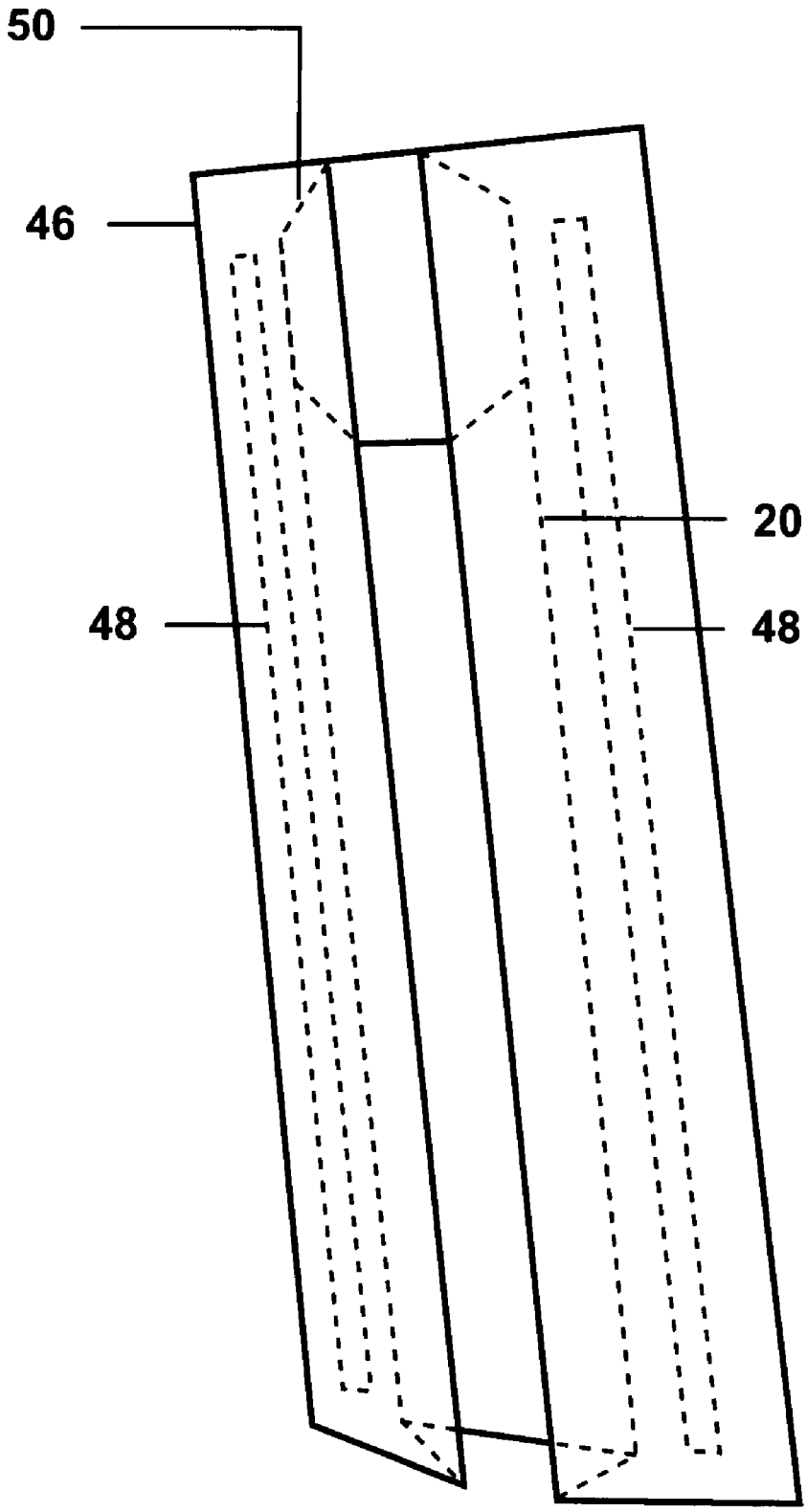
FIG. 5 illustrates one embodiment of slotted panel insert for a beverage holder assembly.

As shown in FIG. 5, track 20 may be formed in plastic panel insert 46 having slots 48 to allow plastic panel insert 46 to be sewn or otherwise attached to beverage housing 16. In various embodiments, track 20 may have an inner diameter substantially equal to the width dimension of head 32 of screw 24 and an outer diameter greater than or substantially equal to the width dimension of neck 34. Track 20 also may have a recessed area 50 at its top corresponding in area to the size of head 32 of screw 24 to allow head 32 of screw 24 to lock in place when slid to the top of track 20.

The head 32 of screw 24 may be slid to the top of track 20 and held in place by the weight of beverage housing 16 and/or the beverage container 18. In some embodiments, the head 32 of screw 24 may lock in place within recessed area 50. The parallel sides of head 32 may abut the inside of track 20 and stabilize beverage housing 16. In general, the octagonal shape is designed to provide the least amount of rotational movement or adjustment necessary to align head 32 of screw 24 with track 20 after clamp device 12 is attached to structure 14 while providing maximum stability.

Figure 6:
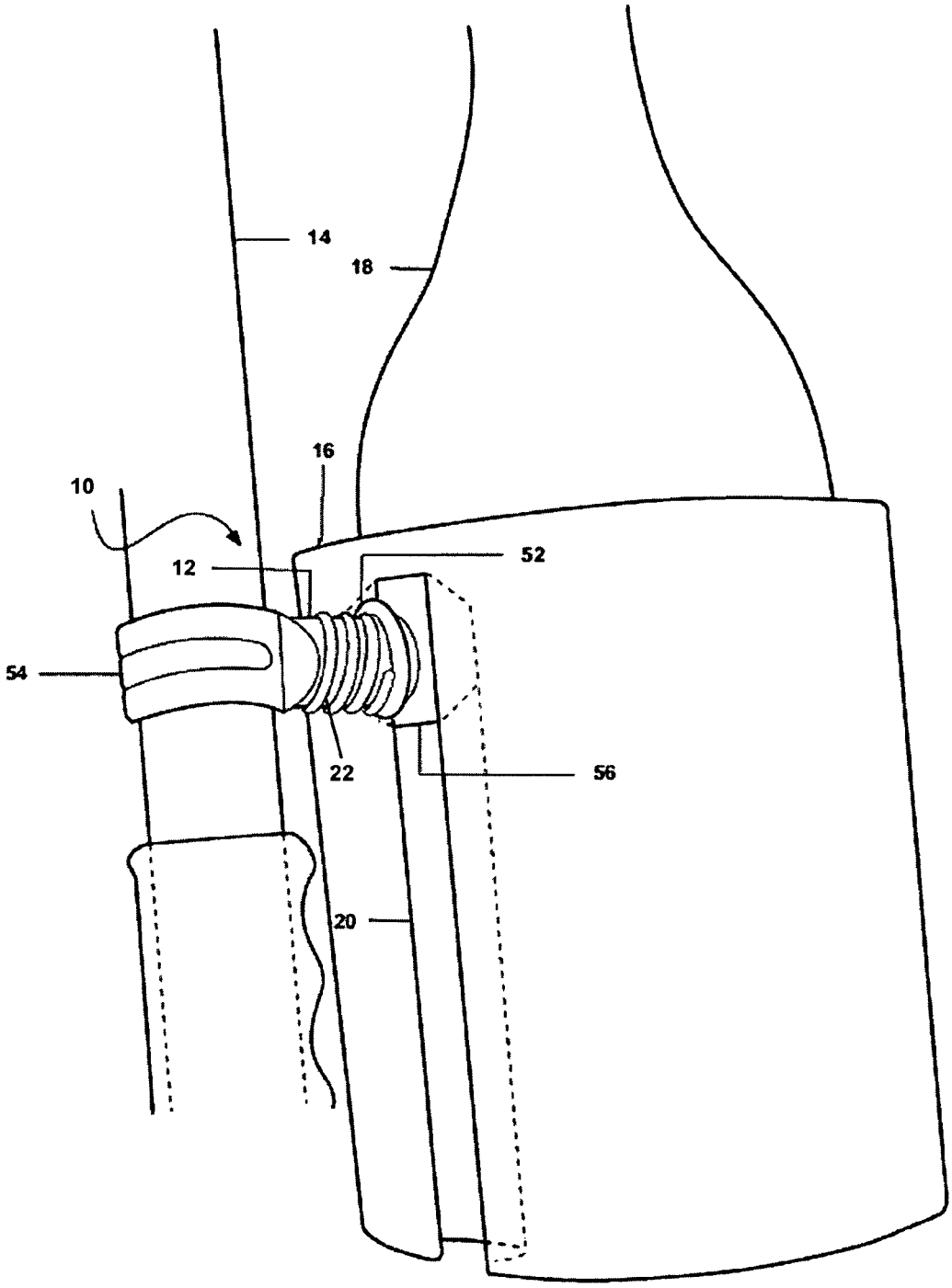
FIG. 6 illustrates another embodiment of a beverage holder assembly.

FIG. 6 illustrates another embodiment of beverage holder assembly 10. Beverage holder assembly 10 is designed to be securely mounted to a structure 14 such as an umbrella, baby stroller, golf cart, bicycle handlebar, beach chair, boat bimini, tree stand, and other similar structures. As shown, beverage holder assembly 10 comprises a clamp device 12 configured to attach to an umbrella shaft. Clamp device 12 also is configured to engage and attach to a separable beverage housing 16 to support beverage container 18. Beverage housing 16 includes track 20.

In this embodiment, clamp device 12 comprises a body portion 22 having a biasing spring 52 and a snap clamp 54. As shown, clamp device 12 comprises a head portion 56 extending from body portion 22. In various embodiments, head portion 56 may have an octagonal shape with parallel sides designed to slide and/or lock within track 20 and to stabilize beverage housing 16.

In some embodiments, various components of beverage holder assembly 10 may be formed from a plastic material. Examples of plastics include, for example, Acrylonitrile-butadiene-styrene (ABS) resin, acetal resin, acrylic resin, fluorocarbon polymer, nylon, phenolformaldehyde resin, polybutilene terephthalate, polycarbonate, polyethylene, polyphenylene oxide, polypropylene, polystyrene, reinforced plastics (FRP), ureaformaldehyde resin, acrylic, polyurethane, polyvinylchloride (PVC), thermoplastics, thermoset plastics, and any combinations and/or compositions thereof including fiber reinforced and carbon fiber reinforced combinations and/or compositions thereof. It can be appreciated that various components of beverage holder assembly 10 also may be constructed of other suitable engineering materials such as one or more metals, alloys, and/or ceramics. In general, the dimensions of the components of beverage holder assembly 10 may vary depending on the desired implementation, and the thickness and rigidity of the components may vary depending on the choice of materials used for construction.

Although the present invention has been described with regard to certain embodiments, those of ordinary skill in the art will recognize that many modifications and variations of the present invention may be implemented. Although the specific embodiments of the several examples described have geometric shapes, the scope of the present invention may encompass any irregular shape or form consistent with aspects of the present invention. The foregoing description and the following claims are intended to cover all such combinations, modifications, and variations of the described embodiments. Furthermore, the components and processes disclosed are illustrative, but are not exhaustive. Other components and processes also may be used to make systems and methods embodying the present invention.

It is worthy to note that any reference to "various embodiments," "one embodiment," or "an embodiment" means that a particular feature, structure, or characteristic described in connection with the embodiment is included in at least one embodiment. Thus, appearances of the phrases "in various embodiments," "in one embodiment," or "in an embodiment" in places throughout the specification are not necessarily all referring to the same embodiment. Furthermore, the particular features, structures or characteristics may be combined in any suitable manner in one or more embodiments.

While certain features of the embodiments have been illustrated as described above, many modifications, substitutions, changes and equivalents will now occur to those skilled in the art. It is therefore to be understood that the appended claims are intended to cover all such modifications and changes as fall within the true spirit of the embodiments.

The invention claimed is:

1. A beverage holder assembly comprising:

a clamp device comprising:

a body portion including a first arm and a second arm, an integrated bottle opener defined by a slot and a protrusion in said body portion, and a screw for tightening said first arm and said second arm to attach said clamp device to a structure, said screw comprising a head having parallel sides; and a beverage housing to support a beverage container, said beverage housing defining a track to receive said head of said screw when said clamp device is attached to said structure.

2. The beverage holder assembly of claim 1, wherein said track has an inner dimension substantially equal to a width dimension of said head of said screw and said parallel sides abut said track when received to stabilize said beverage housing.

3. The beverage holder assembly of claim 1, said head having an octagonal shape.

4. The beverage holder assembly of claim 1, said screw received in a threaded hole defined by said first arm.

5. The beverage holder assembly of claim 1, said first arm comprising an adjustable arm and said second arm comprising a fixed arm.

6. The beverage holder assembly of claim 1, said screw comprising a neck for limiting passage of said screw through said clamp device.

7. The beverage holder assembly of claim 1, wherein said track is defined in a wall of said beverage housing.

8. The beverage holder assembly of claim 1, wherein said track is defined in a panel integrated with said beverage housing.

9. The beverage holder assembly of claim 1, wherein said track has a recessed portion substantially equal in area to said head of said screw.

* * * * *